US010272974B2

(12) United States Patent
Hord et al.

(10) Patent No.: US 10,272,974 B2
(45) Date of Patent: Apr. 30, 2019

(54) BOAT TOWER HINGE

(71) Applicants: Richard W. Hord, Kissimmee, FL (US); Scott J. Mills, Kissimmee, FL (US)

(72) Inventors: Richard W. Hord, Kissimmee, FL (US); Scott J. Mills, Kissimmee, FL (US)

( * ) Notice: Subject to any disclaimer, the term of this patent is extended or adjusted under 35 U.S.C. 154(b) by 0 days.

(21) Appl. No.: 16/109,966

(22) Filed: Aug. 23, 2018

(65) Prior Publication Data

US 2019/0061882 A1 Feb. 28, 2019

Related U.S. Application Data

(60) Provisional application No. 62/551,430, filed on Aug. 29, 2017.

(51) Int. Cl.
*B63B 23/02* (2006.01)
*B63B 21/56* (2006.01)

(52) U.S. Cl.
CPC ..... *B63B 23/02* (2013.01); *B63B 21/56* (2013.01); *Y10T 16/54* (2015.01)

(58) Field of Classification Search
CPC ..... Y10T 16/54; Y10T 16/5403; Y10T 16/54035; B63B 23/02; B63B 21/56; B63B 35/816; B63B 35/815; B63B 15/00; B63B 17/02; E05D 11/08; F16B 2/14
USPC ..... 16/319, 337, 341; 114/253, 242, 343, 114/353, 361; 403/409.1, 374.1, 367
See application file for complete search history.

(56) References Cited

U.S. PATENT DOCUMENTS

| | | | | |
|---|---|---|---|---|
| 7,497,184 | B1 * | 3/2009 | Chaffin | B63B 15/00 114/353 |
| 2004/0011276 | A1 * | 1/2004 | Jackson | B63B 35/815 114/353 |
| 2005/0139139 | A1 * | 6/2005 | Jackson | B63B 35/815 114/343 |
| 2006/0016381 | A1 * | 1/2006 | Schultz | B63B 15/00 114/361 |
| 2006/0087146 | A1 * | 4/2006 | Erskine | B63B 17/02 296/84.1 |
| 2007/0283873 | A1 * | 12/2007 | Jackson | B63B 17/00 114/343 |
| 2011/0209654 | A1 * | 9/2011 | Gasper | B63B 35/815 114/242 |
| 2016/0356067 | A1 * | 12/2016 | James | E05D 11/1014 |

* cited by examiner

*Primary Examiner* — William L Miller
(74) *Attorney, Agent, or Firm* — William M. Hobby, III

(57) ABSTRACT

This invention relates to an improved boat tower hinge which supports a boat tower for use in supporting tow lines used for towing skiers or the like. The hinge can support a boat tower in a raised position while allowing the tower to be swung to a lowered rest position. In the raised tower position the hinge wedges an elongated tongue with polymer sides into an elongated groove having polymer locking inserts to reduce the side-to-side motion of the tower.

12 Claims, 4 Drawing Sheets

BOAT TOWER HINGE

This application claims the benefit of U.S. Provisional Application No. 62/551,430, filed Aug. 29, 2017.

FIELD OF THE INVENTION

This invention relates to a boat tower and especially to the hinge assembly for a folding boat tower such as used for supporting tow lines used for towing skiers or in raising and lowering boat tops.

BACKGROUND OF THE INVENTION

Water sports have gained great popularity including water skiing and wake boarding in which a power boat pulls the skier behind the boat using a tow rope. The tow rope is attached to the boat and has a handle at the other end thereof for the skier to hold onto. These ski boats often have a tower extending above the boat for the tow rope. Tow rope towers are frequently fixed rigidly to the boat but it is desirable to be able to fold the towers when they are not in use.

Boats commonly have a T-top or soft top covering a portion of the hull and it is desirable to be able to fold these tops at times such as when storing the boat.

Hinged folding ski towers on boats in the past have tended to have hinges that allow the towers to wobble or shift position at the hinges when the tower is raised to an upright position of the hinge. It is also difficult to lock and unlock the hinge when raising or lowering the tower.

The present invention is directed towards a hinge for a boat tower to allow the tower to be quickly raised to an upright position and lowered to a rest position. A rigid hinge base is attached to the deck of a boat which base has a rotating hinge arm supporting a tower thereon. The rotating hinge arm stabilizes and locks the arm in the rest position when the tower is raised. This allows the hinge tower to be supported in a firm and rigid manner when the tower is in a raised position without any sway or movement of the hinge pivot arm.

SUMMARY OF THE INVENTION

This invention relates to ski towers on boats and especially to the hinge assembly for a folding boat tower such as used for supporting tow lines used for towing skiers or in the raising and lowering of boat tops. The hinge assembly has a hinged rotating arm having a tower attached thereto which may be rotated between an erect tower position and a lowered position when not in use. The hinge base is attached to the gunnels of the boat or to the deck and has an elongated groove on the top thereof having a tapered polymer member mounted therein. The hinge rotating arm has an elongated tapered tongue having a plastic pad attached to each side thereof which engages and wedges into the base tapered polymer locking member in the base groove.

A boat tower hinge has a hinge base having a bottom portion attachable to a boat and a top portion having an elongated groove therein. The elongated groove has a polymer locking insert having a pair of angled sides attached therein. A hinge pivot arm is pinned to the hinge base and rotatable thereon and has a bottom portion having an elongated tongue having a pair of angled edges shaped to fit into the hinge base elongated groove when said rotatable hinge portion is rotated thereon. The elongated tongue has a pair of angled edges with an elongated polymer member attached to each of the edges. The elongated tongue is sized to wedge the pair of edge elongated polymer members into the groove polymer insert to lock the rotatable hinge portion to the base when wedged therein. An electric actuator is attached to the hinge base and is operatively pinned to a pivot arm extension to rotate the hinge pivot arm.

BRIEF DESCRIPTION OF THE DRAWINGS

The accompanying drawings, which are included to provide further understanding of the invention, are incorporated in and constitute a part of the specification and illustrate an embodiment of the invention and together with the description serve to explain the principles of the invention.

In the drawings.

DETAILED DESCRIPTION OF AN EXEMPLARY EMBODIMENT

This invention is for an improved hinge which supports a boat tower in a raised position while allowing the tower to be swung to a lowered rest position.

Figure 1:
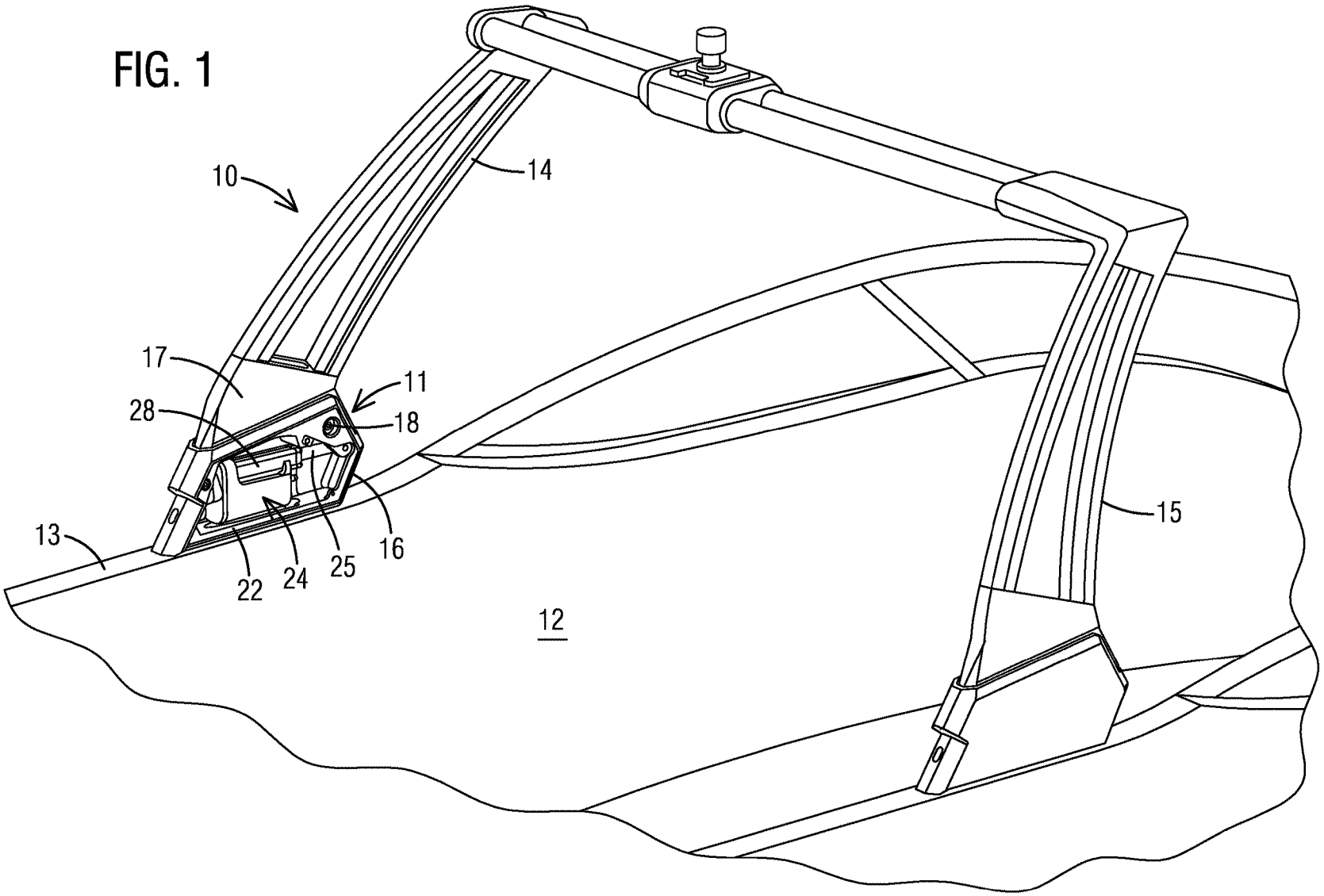
FIG. 1 is a partial perspective of a sectional view of a boat tower attached to a boat with the hinge of the present invention.
Figure 2:
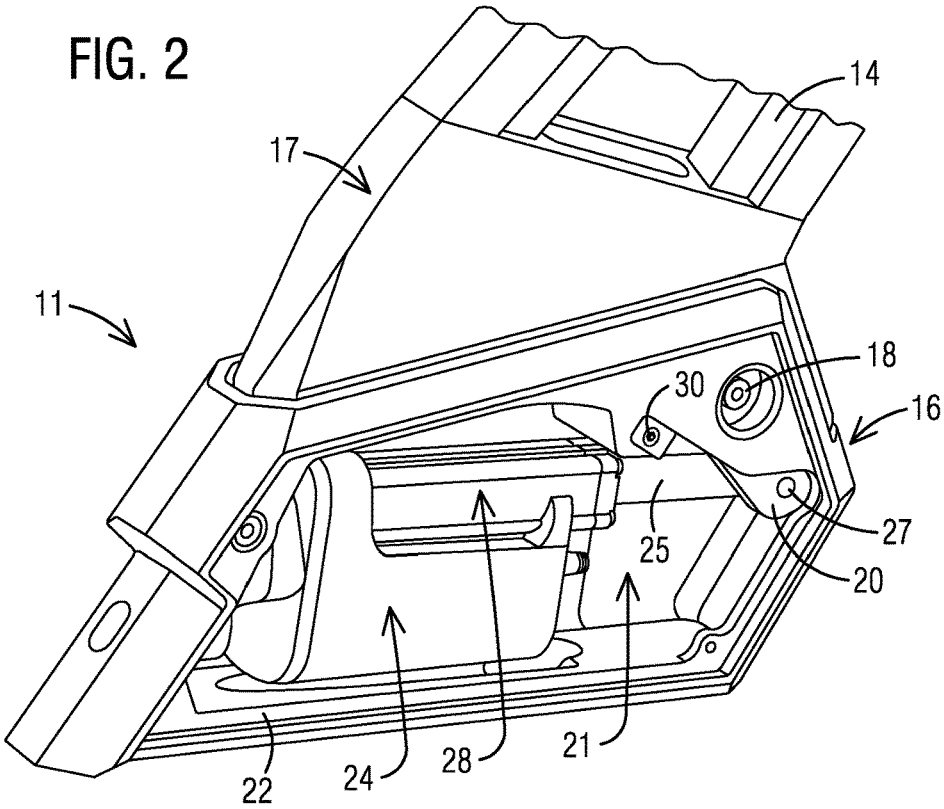
FIG. 2 is a partial perspective view of the closed hinge of FIG. 1.
Figure 3:
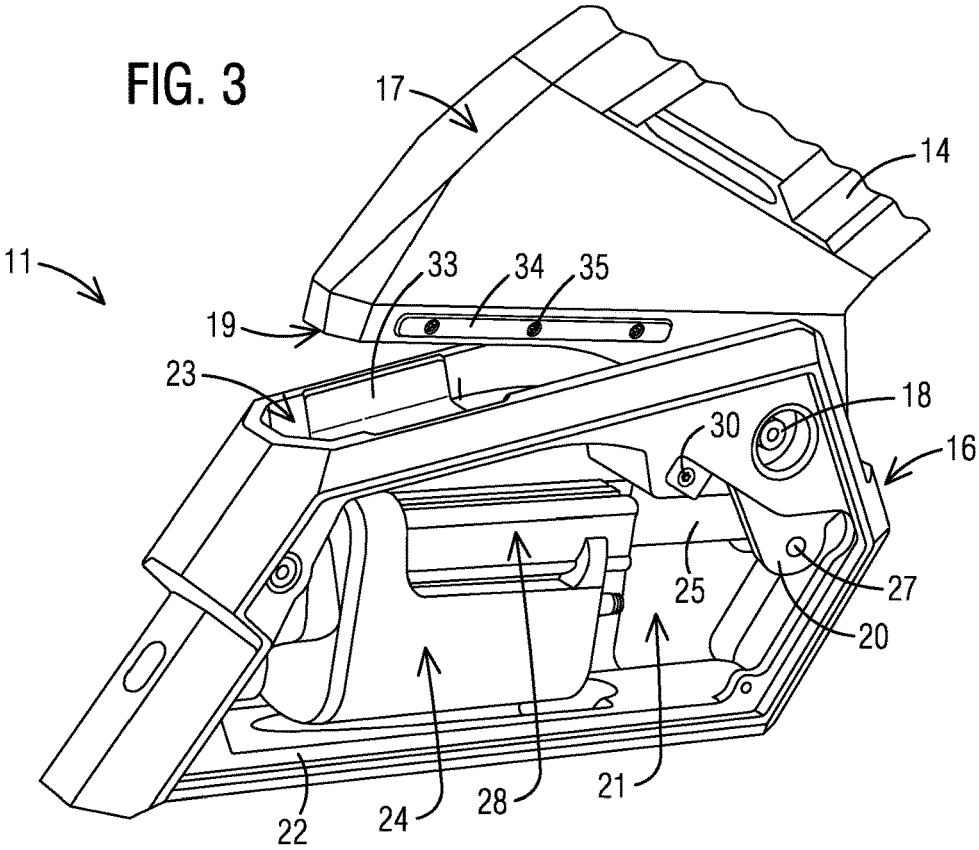
FIG. 3 is a partial perspective of the partially opened hinge of FIGS. 1 and 2.
Figure 4:
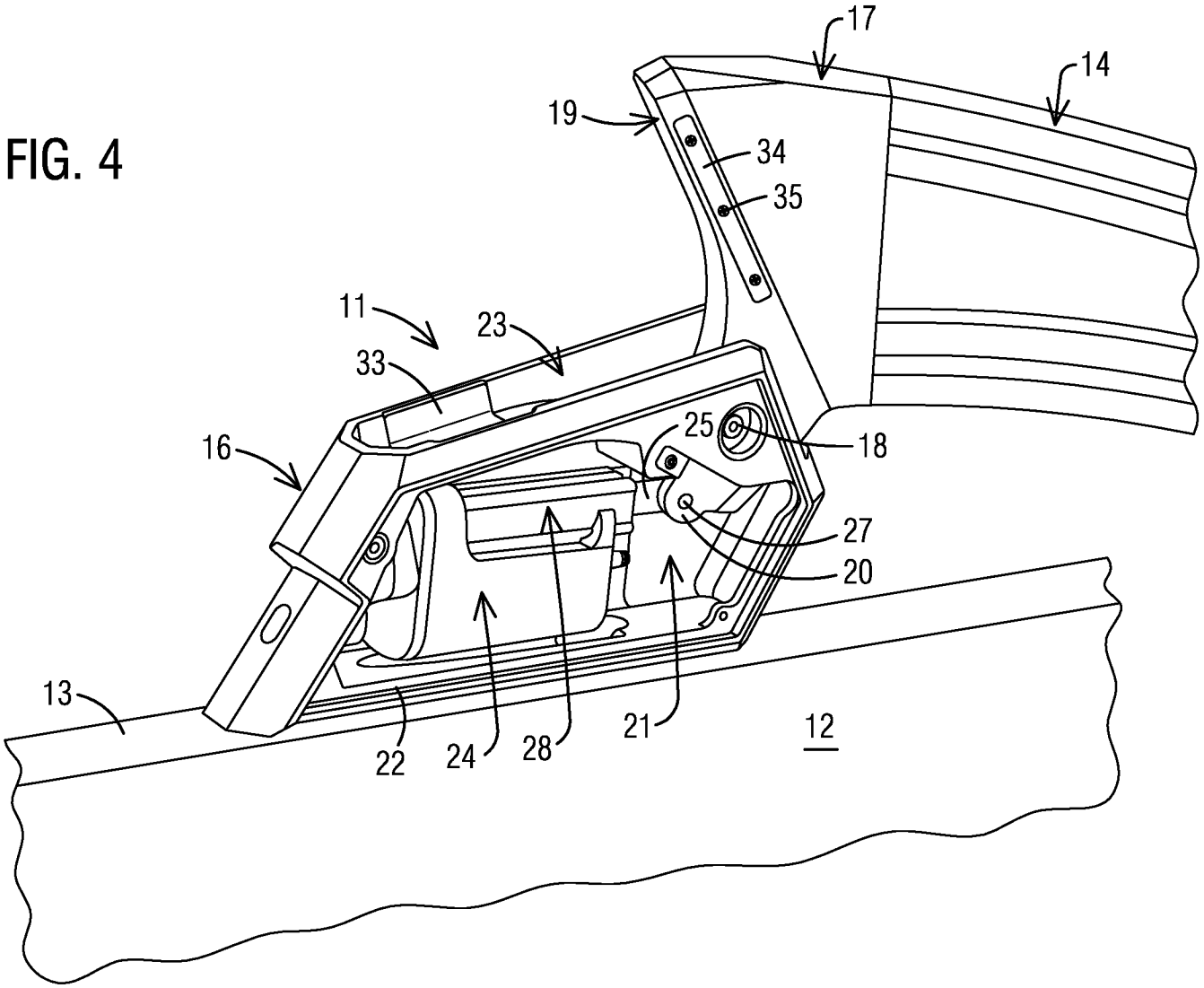
FIG. 4 is a partial perspective of the fully opened hinge of FIGS. 1 through 3.

Referring to the drawings, FIGS. 1 through 6, and especially to FIGS. 1 and 4, a boat tower 10 having hinges 11 is shown attached to a boat 12 gunnels 13. The tower 10 has a pair of tower arms 14 and 15 each having a hinge 11 attached to the boat 12. In FIGS. 1 and 2, the hinge 11 is locked in a closed position with the tower arm 14 and 15 in their fully raised position. FIG. 3 has the hinge 11 in a partially opened position while FIG. 4 has the hinge 11 fully opened to place the tower in a rest or storage position.

The boat hinge 11 has a base 16 attached to the boat 12 having a pivot arm 17 rotatably attached to the base 16 with a hinge pin 18. The hinge pin 18 is attached through the base 16 and through a pivot arm extension 20 extending from the pivot arm 17 to allow the pivot arm 17 and the tower arm 14 to rotate on the hinge base 16. The top of the base has an elongated groove 23 while the pivot arm 17 has an elongated tongue 19 shaped to fit into the elongated groove 23 when the hinge is supporting the tower arms 14 and 15 in an upright position as shown in FIG. 1. The base 16 has an open area 21 with a bottom 22 that attaches to a gunnel wall 13 on a boat 12 and an elongated groove 23 on the top. An electric actuator 24 is mounted inside the open area 21 to the base 16 bottom 22 and has a ram 25 which can be extended and retracted by the actuator when activated by a switch as desired. The actuator can be of any type desired such as an electrically actuated solenoid. The ram 25 is pinned to the pivot arm extension arm 20 at the pivot point 27 which extends below the hinge pin 18 so that when the ram is extended it will drive the pivot arm extension 20 to lift the pivot arm 17 and tower as shown in FIGS. 1 and 2. When the ram 25 is retracted into the cylinder 28 it will pull the extension arm 20 to lower the tower arm 14 as shown by FIGS. 3 and 4. A positive stop 30 is attached to the base 16 which will abut against the pivot arm 20 of the hinge pivot arm 17 to stop the tower in a lowered/stowed position as shown in FIG. 4. The electric actuator will lock the ram 25 in either a raised or lowered position of the tower arms 14 and 15 when the power to the actuator is turned off. Thus the tower can be hoisted from a stowed position to an upright position by the actuation of the electric actuator 24 and rotated to return the tower to a lowered position when not in use, such as when the boat is being moored.

Figure 5:
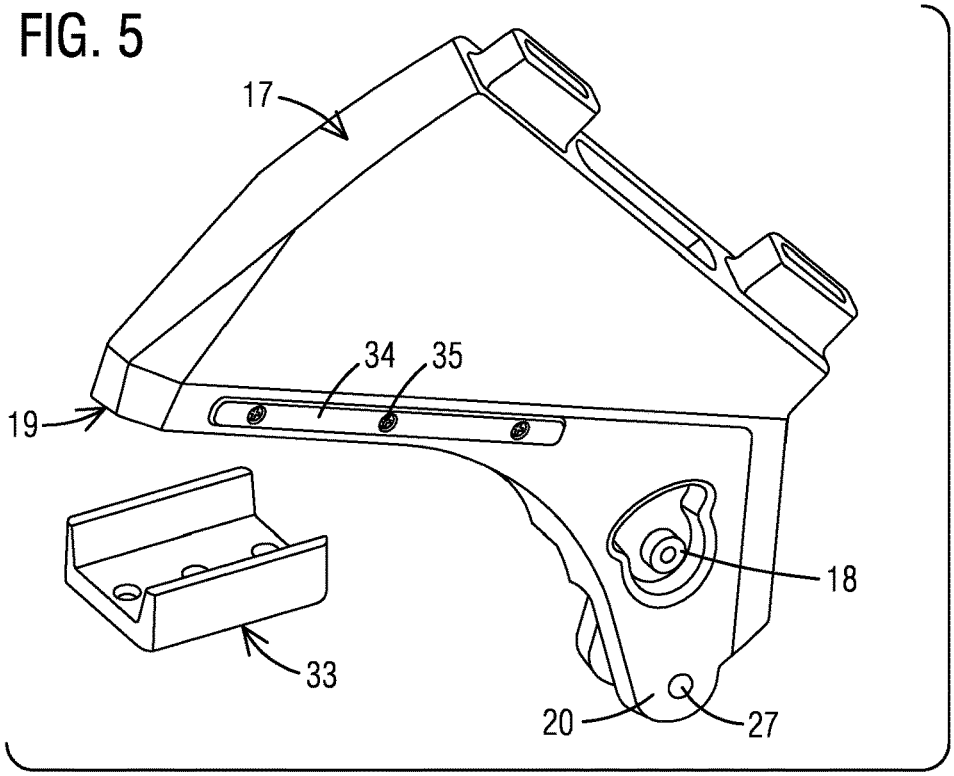
FIG. 5 is an exploded view of the swing arm of the hinge of FIGS. 1-4 wedge lock.
Figure 6:
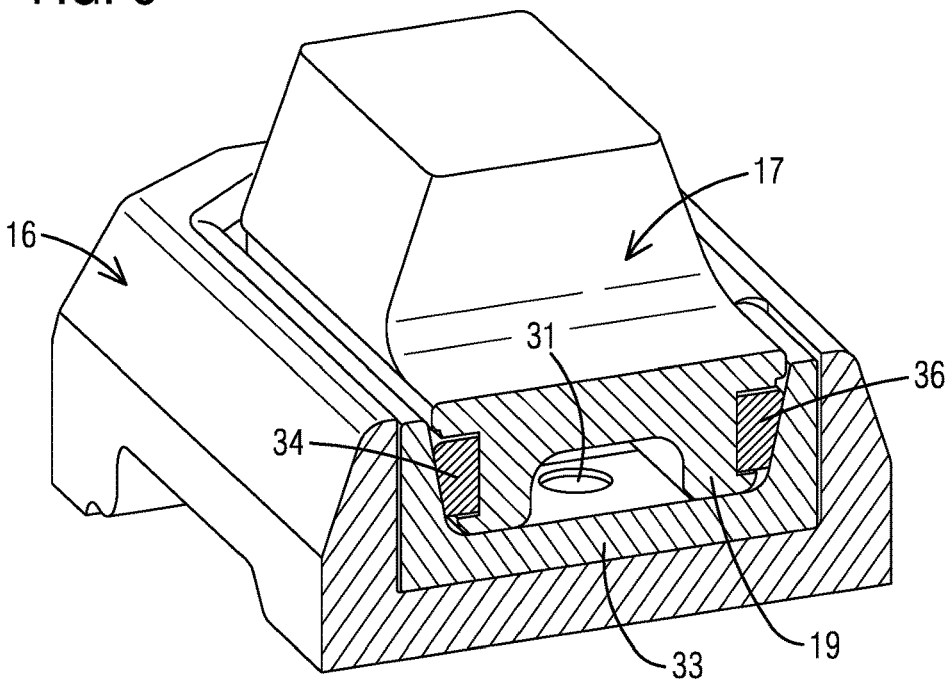
FIG. 6 is a partial perspective of the hinge taper lock of the hinge 1-5.

Referring more specifically to FIGS. 5 and 6, the hinge base 16 is rigidly fastened to the gunnels 13 of the boat 12 or to any solid surface on the boat hull using screw or bolts fastened through the gunnel wall 13. The hinge base 16 is formed with an elongated groove 23 sized for the pivot arm 17 tapered tongue 19 to fit thereinto when the pivot arm 17 is folded to a closed position. The elongated groove 23 has a tapered polymer wedge insert 33 installed therein to form a positive lock when the tongue 19, with elongated polymer members 34 is attached to each edge thereof, is inserted to wedge the tongue 19 elongated polymer members into the polymer groove insert. This locks the base 16 to the pivot arm 17 with the polymer members pressed against each other to avoid any metal to metal contact.

The pivot arm 17 has an elongated polymer tapered wedge pad 34 installed on each edge of the rotating pivot arm 17 tongue 19 using flat head screws 35 as seen in FIGS. 4 and 5. The tapered wedge pads 34 have a taper to match the tapered sides of the tapered polymer wedge 33 attached to the base 16. In this manner the pivot arm 17 is folded or rotated into a closed position lowering the tapered wedge pads 34 to wedge into and lock the pivot arm 17 securely therein against only limited sway so as to block movement to not more than 6 degrees. A preferred polymer for the wedge pads 34 and the tapered lock inserts 33 is polyoxymethylene or DELRIN. It also eliminates contact of the aluminum surfaces between the pivot arm 17 and the base 16. Thus the plastic tapered wedge pads 34 and the plastic taper lock insert 33 have matching taper angles that guide and locate the rotating pivot arm 17 into the plastic taper lock 33.

The tapered angles of the wedge pads 34 wedged into the plastic tapered wedge lock insert 33 limits the side-to-side motion of the pivot arm 17 in a closed position with the tower raised and also eliminates metal to metal contact. The pivot hinge 11 also eliminates any paint on paint or powder coating on powder coating contact. The tapered wedging surfacing also acts as a locking, positive stop and as a guiding surface. A machine pocket 36 as shown in FIG. 6 having a polymer wedge insert indentation having a wedge pad 34 rigidly therein may also be used to further secure the connection between the sides of the tapered insert 33 and the tongue wedge pads 34 if desired.

It should be clear at this time that a boat hinge for supporting a skiing tower, boat top or cover, or the like has been provided. However the present invention is not to be considered limited to the forms shown which are to be considered illustrative rather than restrictive.

We claim:

1. A boat tower hinge comprising:

a hinge base having a bottom portion attachable to a boat, said hinge base having a top portion having an elongated groove therein, said groove having a polymer insert having a pair of angled sides attached therein;

a hinge pivot arm pinned to said hinge base and rotatable thereon and having a bottom portion having an elongated tongue having a pair of angled edges shaped to fit into said elongated groove when said rotatable hinge pivot arm is rotated thereon, said elongated tongue having a pair of angled edges having an elongated polymer member attached to each of said edges, said elongated tongue being sized to wedge said pair of elongated polymer members into said polymer insert to lock said rotatable hinge pivot arm to said base when wedged therein;

whereby wedging said tongue into said insert locks the hinge base and pivot arm together.

2. The boat tower hinge in accordance with claim 1 having an electric actuator attached to said hinge base.

3. The boat tower hinge in accordance with claim 2 in which said rotatable hinge pivot arm has a pivot arm extension having said electric actuator operatively coupled thereto.

4. The boat tower hinge in accordance with claim 3 in which said electric actuator has an extendable and retractable rod pinned to said pivot arm extension.

5. The boat tower hinge in accordance with claim 4 in which each said elongated polymer member attached to said rotatable hinge pivot arm is made of polyoxymethylene.

6. The boat tower hinge in accordance with claim 5 in which said polymer insert has an indentation therein for holding said elongated polymer members thereto.

7. The boat tower hinge in accordance with claim 3 in which said electric actuator has an electric solenoid having an extendable and retractable ram operatively coupled to said pivot arm extension.

8. The boat tower hinge in accordance with claim 4 in which said hinge base has a stop for abutting against said pivot arm extension when said pivot arm is in a lowered and stowed position.

9. The boat tower hinge in accordance with claim 5 in which each said elongated polymer member is attached to each of said edge of said tongue with threaded fasteners.

10. A boat tower hinge comprising:

a hinge base having a bottom portion attachable to a boat, said hinge base having a top portion having an elongated groove therein, said groove having a polymer insert having a pair of angled sides attached therein;

a hinge pivot arm pinned to said hinge base and rotatable thereon and having a bottom portion having an elongated tongue having a pair of angled edges shaped to fit into said elongated groove when said rotatable hinge pivot arm is rotated thereon, said elongated tongue having a pair of angled edges having an elongated polymer member attached to each of said edges, said elongated tongue being sized to wedge said pair of elongated polymer members into said polymer insert to lock said rotatable hinge pivot arm to said base when wedged therein, said hinge pivot arm having a pivot arm extension;

an electric actuator attached to said hinge base and having an extendable ram coupled to said pivot arm extension for raising or lowering said hinge pivot arm between an operative raised position to a collapsed rest position;

whereby wedging said tongue into said insert locks the hinge base and pivot arm together.

11. The boat tower hinge in accordance with claim 10 in which each said elongated polymer member attached to said tongue is made of a Delrin polymer.

12. The boat tower hinge in accordance with claim 10 in which said hinge base has a stop for abutting against said pivot arm extension when said pivot arm is in a lowered and stowed position.

* * * * *